United States Patent [19]

Dreier

[11] Patent Number: 4,580,516

[45] Date of Patent: Apr. 8, 1986

[54] SEWING MACHINE CLAMP-TYPE FEED

[75] Inventor: Ernst Dreier, Steckborn, Switzerland

[73] Assignee: Fritz Gegauf Aktiengesellschaft Bernina-Nähmaschinenfabrik, Steckborn, Switzerland

[21] Appl. No.: 700,970

[22] Filed: Feb. 12, 1985

[30] Foreign Application Priority Data

Feb. 29, 1984 [CH] Switzerland ..... 973/84

[51] Int. Cl.[4] ..... D05B 27/06

[52] U.S. Cl. ..... 112/311; 112/320

[58] Field of Search ..... 112/320, 311

[56] References Cited

U.S. PATENT DOCUMENTS 1,260,772 3/1918 Hemleb ..... 112/311

3,099,974 8/1963 Chudner ..... 112/311

FOREIGN PATENT DOCUMENTS 2916193 10/1980 Fed. Rep. of Germany ..... 112/311

503824 4/1971 Switzerland ..... 112/320

*Primary Examiner*—Werner H. Schroeder

*Assistant Examiner*—Andrew M. Falik

*Attorney, Agent, or Firm*—Birch, Stewart, Kolasch & Birch

[57] ABSTRACT

An alternating presser foot with a vertically movable sole portion, fixed in the feeding direction of a feed dog, and a clamping pressure foot adapted to be placed on sewing material relative to the movable sole portion by means of a drive lever which cooperates with a needle bar for movement along with the sewing material in the feeding direction of the feed dog. For transmission of motion from the drive lever to said clamping pressure foot, an angle lever is provided, one arm of which, extends approximately vertically, defining a guide cam cooperating with a follower of the drive lever, while the other arm thereof extends approximately horizontally defining a pressure element for stressing said clamping pressure foot in order to place it in engagement with the sewing material. The clamping pressure foot entrained, in turn, is operatively connected to the lower end of a cam member which is suspended in a pendulating manner, said cam member having a cutout portion that narrows in the downwardly direction approximating a V-shape configuration. The lower, narrowed end portion of said cutout portion cooperates with a centering element of the drive lever for determining the neutral starting position of said clamping pressure foot, whereas the upper, widened cutout portion makes possible a pendulating motion of the cam member providing for the engagement of the clamping pressure foot with the sewing material being moved by the feed dog.

16 Claims, 3 Drawing Figures

2
1
13c
4
13
3
16a
5
14c
13b
13a
16
14
14a
8a
12
14b
15
5a
6a
7
6
8
9a
A
7a
B

SEWING MACHINE CLAMP-TYPE FEED

BACKGROUND AND SUMMARY OF THE INVENTION

The present invention relates to an alternating presser foot with a vertically movable sole portion, fixed in the feeding direction of the feed dog, and provided with a clamping pressure foot which can be placed on the sewing material relative to the movable sole portion by means of a drive lever cooperating with the needle bar and which moves along with the sewing material in the feeding direction of the feed dog.

A presser foot of this type has been known, for example, from Swiss Patent No. 503,824. The drive lever, connected to the needle bar for movement therewith, cooperates by way of a first roller with a cam lever for the purpose of operating the fixed sole portion. A second roller of the drive lever cooperates with a V-shaped cam for the purpose of centering the clamping pressure foot, encompassing the fixed sole portion, in its neutral position. The clamping pressure foot is movably connected to the shank of the presser foot by way of a parallelogram, the roller of the drive lever impinging almost vertically on the cam lever forming part of the parallelogram. This arrangement tends to generate a large amount of noise and is prone to increased wear and tear. The same holds true for the entering of the second roller into the V-shaped cam groove, the position of which is determined by the position of advancement of the entrained sole portion. The angle of impingement of this second roller is variable so that the noise also becomes greater, the longer the advancement.

Another disadvantage of this kind of arrangement is the small fixed sole portion which, although securing the sewing material together with the penetrated needle against shifting in the sewing direction, can prevent only with difficulties, the rotation of the sewing material about the needle penetration point. The small basal surface of the fixed sole portion can furthermore cause markings on sensitive sewing material which thereafter remain visible.

In contrast thereto, the present invention has the object of providing an alternating presser foot of the aforementioned type wherein there is not only the assurance of a perfect centering of the clamping pressure foot in its neutral position, but wherein the presser foot also operates at low noise and with low wear and tear.

SUMMARY OF THE INVENTION

For this purpose, the presser foot which alternates according to the present invention is characterized in that an angle lever is provided for transmitting motion from the drive lever to the clamping pressure foot. One arm of this drive lever, which extends approximately vertically, comprises a guide cam cooperating with a follower of the drive lever, while the other, approximately horizontal arm exhibits a pressure element for stressing the clamping pressure foot in order to place the same in engagement with the sewing material. This clamping pressure foot, in turn, is articulated in the lower end of a cam member suspended in a pendulating fashion. This cam member exhibits a cutout narrowing portion extending in the downward direction in an approximate V-shape configuration. The lower, narrowed portion of this cutout determines, in cooperation with a centering member of the drive lever, the neutral starting position of the clamping pressure foot. The upper, widened cutout portion provides a pendulating motion of the cam member, making it possible for this sole portion to move along with the sewing material moved by the feed dog.

The clamping pressure foot, suitably guided in an upper guide groove of the fixed sole portion and extending downwardly by means of vertical stems through slots in this sole portion, advantageously consists of a synthetic resin and is fixed to one end of a leaf spring, the other end of which is articulated to the cam member. The pressure element at the angle lever, as well as the entrainment means and the centering portion at the drive lever are suitably rollers. Thanks to the approximately vertical arrangement of the arm of the angle lever, exhibiting the guide cam for the entrainment means, on the one hand, and the narrowed portion of the cam member cutout, accommodating the centering element in a lifted neutral position for centering the clamping pressure foot, on the other hand, and due to the fact that the entrainment means and the centering element likewise move approximately vertically upon a movement of the drive lever under the action of the reciprocating needle bar, the entering of the entrainment means onto the guide cam, as well as the entrance of the centering element into the narrowed portion of the cutout of the cam member takes place practically without impacts.

Suitably, springs engaging the cam member are provided, tending to maintain the cam member in a pendulating position corresponding to the neutral position of the clamping pressure foot so that this cam member, when the clamping pressure foot is relieved, by the pressure element of the angle lever and directly prior to entrance of the centering element into the narrowed cutout portion, is perforce placed into the neutral pendulating position; thanks to the pendulating suspension of the cam member, its own weight can, of course, also contribute toward the desired return into the neutral pendulating position.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
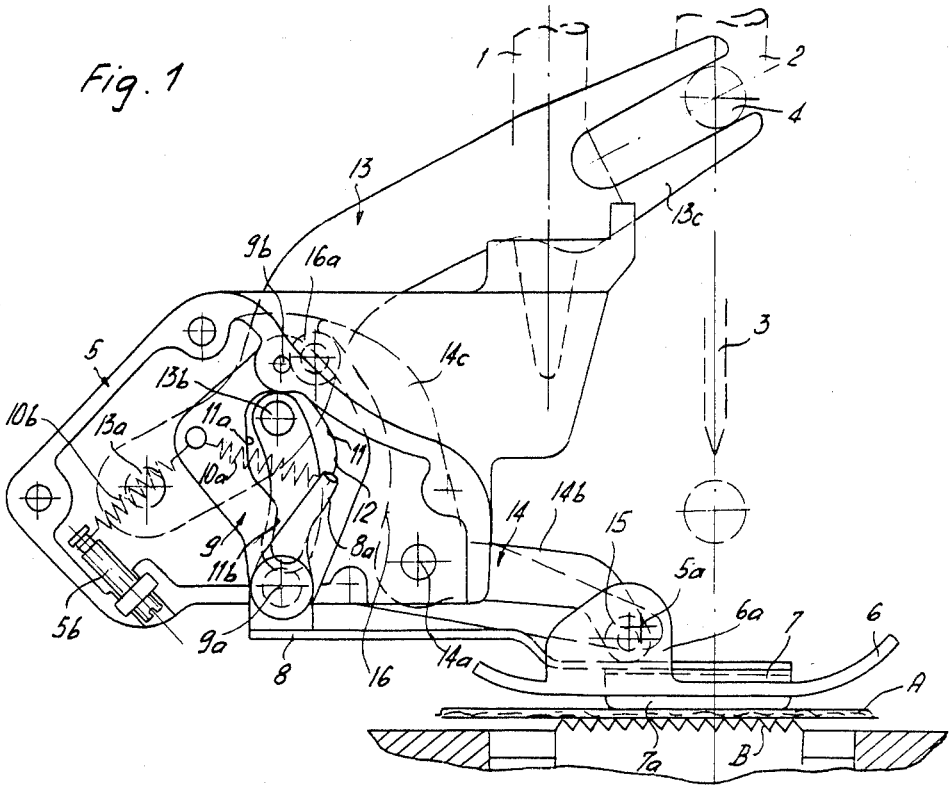
FIG. 1 shows, in a lateral view, the presser foot with the sewing needle disposed in a raised position.

In the drawings, element 1 denotes the presser bar which, as is conventional, is under spring pressure. Element 2 denotes the needle bar which is parallel to the presser bar. The needle bar carries the needle 3 and comprises a follower pin 4. A housing 5 which can be closed by lateral covers (not shown) is attached to the presser bar. As indicated by the axis 5*a*, the so-called fixed sole portion 6, provided with a needle hole, is articulated with limited pivotability to lateral extensions of the housing 5. The clamping pressure foot 7 is guided on the sole portion 6 between lateral tongs 6*a* of the sole portion, serving for articulation; this sole portion 7 is provided with longitudinal stems 7*a* which can project downwardly through slots in the fixed sole portion 6. The clamping pressure foot 7, advantageously made from an elastomer, is attached to the free end of a leaf spring 8, the other end of which being articulated to the lower end of a cam member 9 at 9*a*. The cam member 9, having a central cutout, is suspended from its upper end at 9*b* in a pendulating fashion at the housing 5. A pair of springs, one of which 10*a*, engages a lug 8*a* of the mounting end of the leaf spring 8 and the other spring 10*b* engages a screw 5*b* adjustably disposed at the housing 5, retains the cam member 9 in a predetermined neutral position. The central cutout 11 of the cam member 9, the boundary wall of which forms a continuous cam track, exhibits an upper, relatively wide portion 11*a* passing toward the bottom into a V-shaped configuration with a narrowed portion 11*b*. An approximately circularly curved slot 12 is provided in the central wall of the housing 5, in alignment with the central cutout 11 of the cam member 9. A centering pin 13*b* seated in a drive lever 13 pivotably attached at 13*a* to the housing wall, projects through the wall slot 12 into the central recess 11 of the cam member 9, and its diameter corresponds to the width of the narrowed cutout portion 11*b*. The free end portion of the drive lever 13 is fashioned as a fork 13*c* encompassing the following pin 4 at the needle bar 2. Furthermore, an angle lever 14 is supported at 14*a* in the housing 5. One arm 14*b* of the angle lever 14, which is disposed in an approximately horizontal position, extends over the clamping pressure foot 7 and rests on this sole portion 7 by means of lateral rollers 15. The other arm 14*c* of the angle lever 14, which extends in the vertically upward direction, is fashioned as a guide cam 16 on its rear side. A guide roller 16*a* supported on the drive lever 13 cooperates with the guide cam 16.

Figure 2:
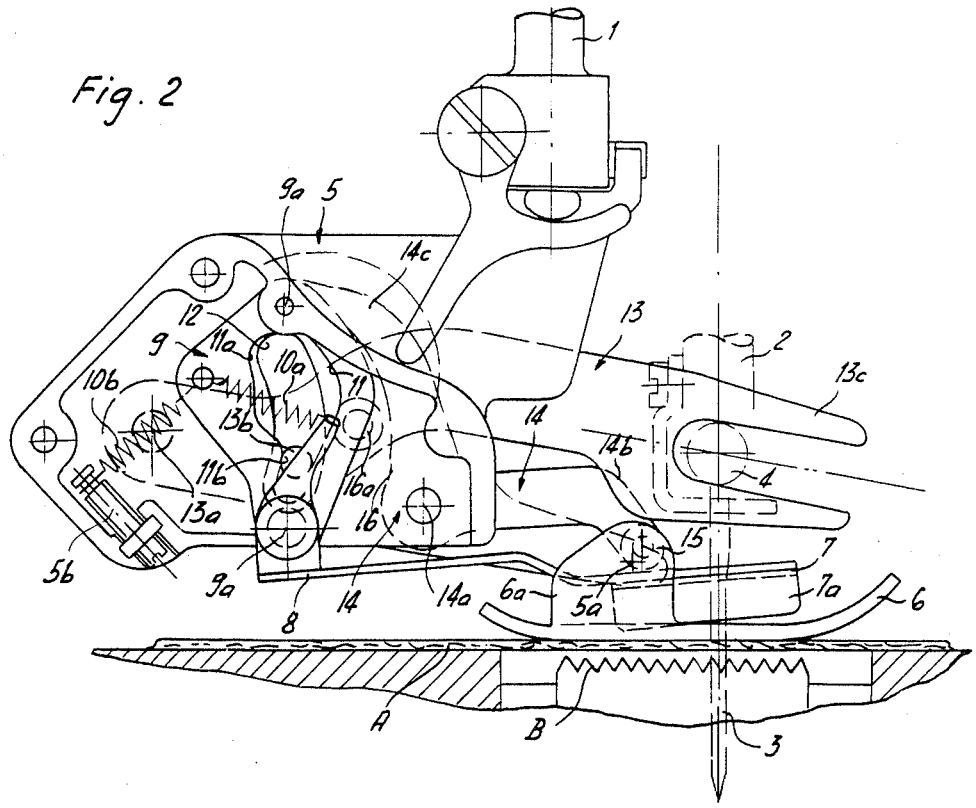
FIG. 2 shows an analogous view with the sewing needle being disposed in its lower end position.
Figure 3:
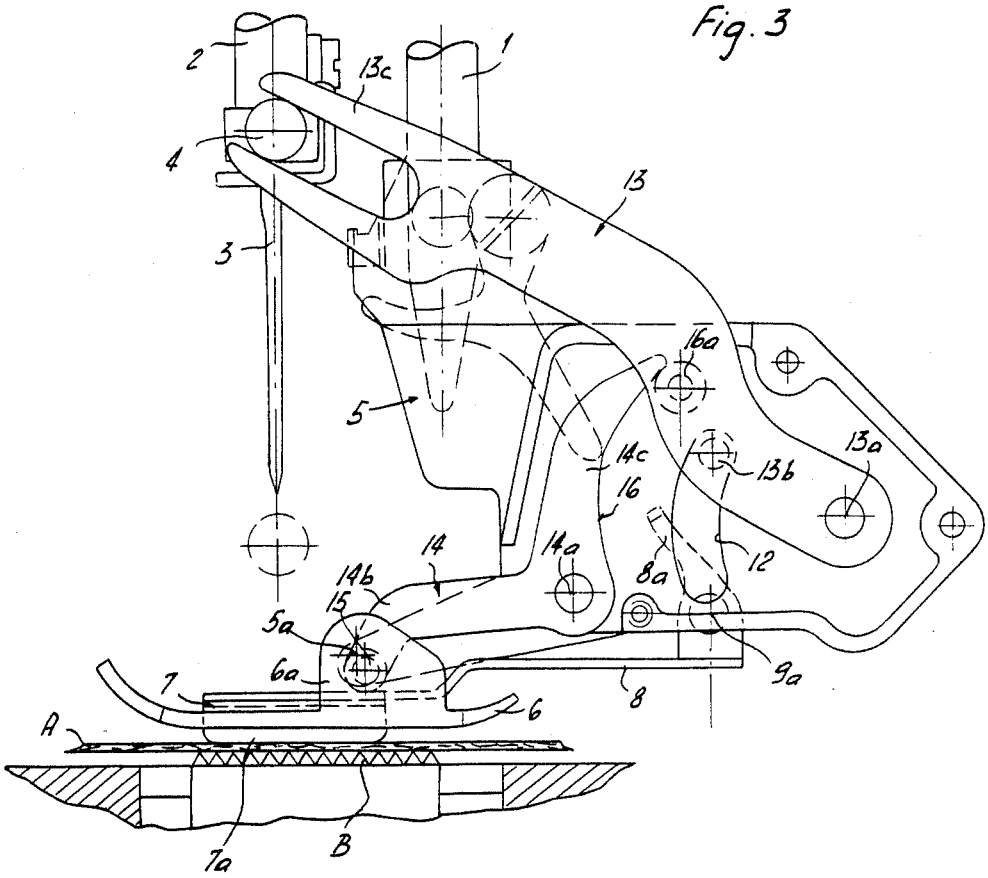
FIG. 3 shows a view analogous to FIG. 1, seen from the other side of the presser foot.

The following mode of operation results from the structure of the alternating presser foot described above:

In the position of the presser foot parts shown in FIGS. 1 and 3, the needle 3 is in its upper end position. In this upwardly pivoted position of the drive lever 13, the guide roller 16*a* is in contact with the upper end portion of the guide cam 16 of the lever arm 14*c* and retains the latter in a position wherein the rollers 15 at the other lever arm 14*b* press the clamping pressure foot 7 with its longitudinal ridges 7*a* through the slots in the fixed sole portion 6 onto the sewing material A while the fixed sole portion 6 is slightly lifted off the sewing material A. Thus the entrained sole portion 7 can follow the advancing motion imparted to the sewing material by the feed dog indicated at B. In this upwardly pivoted position of the drive lever 13, the centering pin 13*b* is in the relatively wide cutout portion 11*a* of the cam member 9, so that the latter can be pivoted by the clamping pressure foot 7, unimpeded by the centering pin, about its pendulating axis 9*b*. During the subsequent downward stroke of the needle bar 2, causing a corresponding pivoting of the drive lever 13, the angle lever 14 and thus the clamping pressure foot 7 are relieved by the guide roller 16*a* following a shallower cam track of the guide cam 16, whereas the vertically movable sole portion comes into engagement with the sewing material. The springs 10*a*, 10*b*, engaging the cam member 9, return the cam 9 into its neutral position whereby the sole portion 7, lifted off the sewing material A by the effect of the leaf spring 8, is returned into its centering position. During this process, the centering pin 13*b* slides along the drive lever 13 into the narrowed portion 11*b* of the cutout 11, so that the lifted sole portion 7, with the needle 3 penetrating the material (FIG. 2), is fixed in its centering position as determined by the cam member 9. During the renewed upward motion of the needle 3 and the corresponding depressing of the clamping pressure foot 7, the latter comes to lie on the sewing material A in its centering position, from which it can follow in both directions the maximum possible feed dog stroke.

As can be seen from the drawing, when the needle bar 2 moves in the upward direction, the guide roller 16*a* enters the guide cam 16 of the angle lever 14 at a very acute angle so that neither wear nor tear or troublesome striking noises can occur. Analogous operations apply in connection with the entrance of the centering pin 13*b* into the narrowed portion 11*b* of the central cutout 11 of the cam member 9. Here an undesired impacting of the centering pin 13*b* on the cam track sections which narrow in the V-shape portion is prevented due to the fact that immediately upon a relieving of the clamping pressure foot 7 by the rollers 15, the springs 10*a*, 10*b* place the cam member 9 into the neutral position, ensuring an impact-free entrance of the centering pin 13*b* into the narrowed cutout portion 11*b*.

Since the clamping pressure foot 7 is guided within the fixed sole portion 6, the latter can be relatively broad, i.e. it can be designed like the sole of a customary, non-alternating presser foot. In this way, with the needle 3 penetrating the material, the pressure exerted by the sole portion 6 on the sewing material A is distributed over a relatively large area so that the sewing material is held gently, but sufficiently firmly against unintended rotation. The narrow pressure stems 7*a* of the inner, clamping pressure foot 7 come into contact with the sewing material in a correspondingly gentle fashion, with the needle being lifted, so that permanent marking of the sewing material is avoided.

Thanks to the adjustability of the spring 10*b* by means of the screw 5*b*, the neutral position of the cam member 9 can be rather accurately set, in spite of the usual, relatively large spring tolerances.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An alternating presser foot with a vertically movable sole portion, fixed in the feeding direction of a feed dog, and with a sole portion defining a clamping pressure foot which is adapted to be placed on sewing material relative to the movable sole portion by means of a drive lever which cooperates with a needle bar for movement along with the sewing material in the feeding direction of the feed dog, characterized in that for transmission of motion from the drive lever to the clamping pressure foot, an angle lever is provided, one arm of which extends approximately vertically, defines a guide cam cooperating with a follower of the drive lever, while the other arm thereof, which extends approximately horizontally defines a pressure element for stressing the clamping pressure foot in order to place said sole portion in engagement with the sewing material, said clamping pressure foot, in turn, being operatively connected to the lower end of a cam member which is suspended in a pendulating manner, said cam member having a cutout portion that narrows in a downwardly direction approximating a V-shape configuration, the lower, narrowed end portion of said cutout portion cooperating with a centering element of the drive lever for determining the neutral starting position of the clamping pressure foot, whereas the upper, widened cutout portion makes possible a pendulating motion of the cam member providing for the entrainment of the sole portion with the sewing material being moved by the feed dog.

2. The presser foot according to claim 1 wherein the clamping pressure foot is guided in a groove defined by lateral tongs of the fixed sole portion, and extends with longitudinal stems through slots in the fixed sole portion.

3. The presser foot according to claim 2 wherein the clamping pressure foot is operatively connected by means of a leaf spring to the lower end of the cam body, said cam body being stressed by means of adjustable spring means toward its neutral position.

4. The presser foot according to claim 3 wherein the pressure element of the angle lever has a pair of rollers cooperating with the topside of the clamping pressure foot.

5. The presser foot according to claim 3 wherein the fixed sole portion is operatively connected to a support housing attached to the presser bar, and the angle lever as well as the drive lever are connected to one side of a central wall of the supporting housing, the drive lever exhibiting a centering pin which projects through a slot in the central wall into the cutout of the cam member supported on the other side of the wall in a pendulating fashion.

6. The presser foot according to claim 2 wherein the follower of the drive lever is a guide roller, the path of motion of which extends at an acute angle toward the guide cam of the angle lever.

7. The presser foot according to claim 2 wherein the pressure element of the angle lever has a pair of rollers cooperating with the topside of the clamping pressure foot.

8. The presser foot according to claim 2 wherein the fixed sole portion is operatively connected to a support housing attached to the presser bar, and the angle lever as well as the drive lever are connected to one side of a central wall of the supporting housing, the drive lever exhibiting a centering pin which projects through a slot in the central wall into the cutout of the cam member supported on the other side of the wall in a pendulating fashion.

9. The presser foot according to claim 1 wherein the clamping pressure foot is operatively connected by means of a leaf spring to the lower end of the cam body, said cam body being stressed by means of adjustable spring means toward its neutral position.

10. The presser foot according to claim 9 wherein the follower of the drive lever is a guide roller, the path of motion of which extends at an acute angle toward the guide cam of the angle lever.

11. The presser foot according to claim 9 wherein the pressure element of the angle lever has a pair of rollers cooperating with the topside of the clamping pressure foot.

12. The presser foot according to claim 9 wherein the fixed sole portion is operatively connected to a support housing attached to the presser bar, and the angle lever as well as the drive lever are connected to one side of a central wall of the supporting housing, the drive lever exhibiting a centering pin which projects through a slot in the central wall into the cutout of the cam member supported on the other side of the wall in a pendulating fashion.

13. The presser foot according to claim 1 wherein the follower of the drive lever is a guide roller, the path of motion of which extends at an acute angle toward the guide cam of the angle lever.

14. The presser foot according to claim 13 wherein the fixed sole portion is operatively connected to a support housing attached to the presser bar, and the angle lever as well as the drive lever are connected to one side of a central wall of the supporting housing, the drive lever exhibiting a centering pin which projects through a slot in the central wall into the cutout of the cam member supported on the other side of the wall in a pendulating fashion.

15. The presser foot according to claim 1 wherein the pressure element of the angle lever has a pair of rollers cooperating with the topside of the clamping pressure foot.

16. The presser foot according to claim 1 wherein the fixed sole portion is operatively connected to a support housing attached to the presser bar, and the angle lever as well as the drive lever are connected to one side of a central wall of the supporting housing, the drive lever supporting a centering pin which projects through a slot in the central wall into the cutout of the cam member supported on the other side of the wall in a pendulating fashion.

* * * * *